US005435852A

United States Patent [19]

Robinson

[11] Patent Number: 5,435,852

[45] Date of Patent: Jul. 25, 1995

[54] MOP ASSEMBLY

[76] Inventor: Richard E. Robinson, 1825 Hillcrest St., Fort Worth, Tex. 76107

[21] Appl. No.: 301,663

[22] Filed: Sep. 7, 1994

[51] Int. Cl.[6] ..... B08B 7/00; A47L 13/20

[52] U.S. Cl. ..... 134/6; 15/147.1; 15/150; 15/229.6

[58] Field of Search ..... 134/6; 15/147.1, 148, 15/149, 150, 151, 152, 153, 154, 228, 229.1, 229.6

*Primary Examiner*—David A. Simmons
*Assistant Examiner*—Sean Vincent
*Attorney, Agent, or Firm*—Charles D. Gunter, Jr.

[57] ABSTRACT

An improved mop assembly is shown having a pair of mop holders which grip a mop fabric. The mop holders can be rotated about the axis of the mop handle so that the previously exposed contact surfaces of the mop fabric are reversed with the inner mop surfaces, thereby presenting unsoiled mop fabric for continued mopping.

10 Claims, 5 Drawing Sheets

MOP ASSEMBLY

BACKGROUND OF THE INVENTION

1. Field of the Invention

The present invention relates generally to maintenance items used in cleaning, custodial and janitorial endeavors and, specifically, to an improved fabric type mop having dual rotation mop holders which provide additional clean mop surfaces during use of the device.

2. Description of the Prior Art

Mop type implements for washing or polishing floors have been known since the earliest times. The typical mop design comprises a bundle of loose rags, yarns, a sponge, etc., bound to the end of a stick, as for washing floors. A common fabric mop utilizes a section of fabric, such as strands of yarn which are sewn together to form a generally rectangular body of material which is doubled over in the center, the center portion being connected at the mop holder. A stick or other handle extends from the mop holder. As a result of the doubling over of the fabric, two outer surfaces of fabric and two inner surfaces are present. Unfortunately, only the outer, exposed surfaces of the mop are available for use in mopping a work surface. If the number of exposed surfaces could be multiplied, the mop could cover a larger work surface during use without requiring that the mop be dipped in liquid and wrung out. Obviously, cutting down on the number of times the mop must be dipped and wrung out increases a worker's efficiency and convenience.

The present invention has as one object to provide an improved mop assembly which will increase the available exposed surface areas of mop fabric during use, thereby decreasing the number of times the mop must be dipped and wrung out.

Another object of the invention is to provide such an improved mop assembly which is simple in design and economical to manufacture.

Another object of the invention is to provide such an improved mop assembly which can be easily used by a relatively unskilled worker, the operation of the mop requiring only a simple series of movements to present the additional exposed surface areas of mop fabric.

Another object is to provide such an improved mop assembly which allows removal and replacement of the mop fabric so that the remaining assembly can be reused.

SUMMARY OF THE INVENTION

The improved mop assembly of the invention includes a pair of mop holders, each holder holding an associated mop fabric having an inner contact surface and an outer contact surface. The mop assembly has a handle having a longitudinal axis, the handle being connected to the pair of mop holders and being necessary for positioning the mop holders in relation to a work surface. Rotating means are provided for pivoting the mop holders about the longitudinal axis of the handle during use, whereby the inner and outer contact surfaces of the mop fabric are reversed.

Preferably, the improved mop assembly includes a support plate connected to the handle, the support plate having a transverse opening therein. A rotor shaft has a central portion which is received within the transverse opening of the support plate and has oppositely arranged outer extents, each outer extent being pivotally connected to a selected one of the pair of mop holders, whereby rotation of the mop handle about the longitudinal axis rotates the support plate and the rotor shaft, causing the mop holders to pivot about the longitudinal axis of the handle, whereby the inner and outer contact surfaces of the mop fabric are reversed. The mop fabric is preferably a sewn yarn fabric.

Each mop holder is preferably provided with an inner face and an outer face, each of the inner and outer faces having a plurality of locking means such as lug notches formed therein. The support plate has an end face with mating locking means such as locking lugs formed thereon. The locking means cooperate so that the locking lugs of the support plate end face are received within the lug notches of selected ones of the mop holders during use, whereby the mop heads work in tandem or unison during normal use of the mop assembly.

The central portion of the rotor shaft is a generally cylindrical member which is closely received within a cylindrical opening provided in the support plate. The rotor shaft has oppositely arranged outer extents extending generally perpendicular to the opposing planar faces of the support plate in the preferred embodiment. The mop holders comprise mating sets of clamshell grippers having end openings and cooperating gripping surfaces for gripping a portion of mop fabric. The end opening of each set of mating clamshell grippers is preferably adjustable in size to accommodate mop fabric of various types and thicknesses.

Additional objects, features and advantages will be apparent in the written description which follows.

DETAILED DESCRIPTION OF THE INVENTION

Figure 1A:
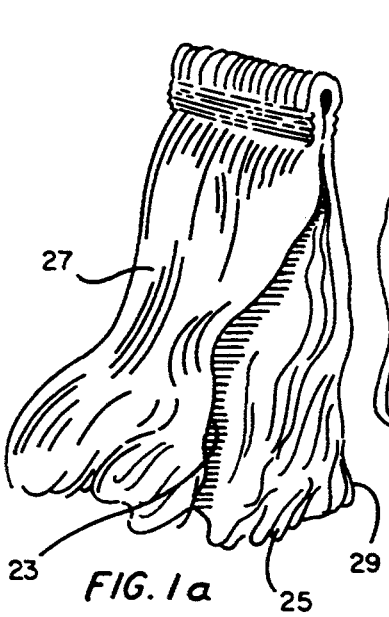
FIG. 1*a* is a perspective view of a piece of conventional mop fabric showing the fabric doubled over for attachment to a mop holder.
Figure 1B:
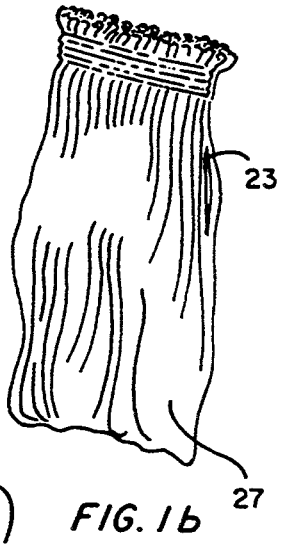
FIG. 1*b* is a view of the left half of the mop fabric of FIG. 1 showing the fabric separated for use in the mop assembly of the invention.
Figure 1C:
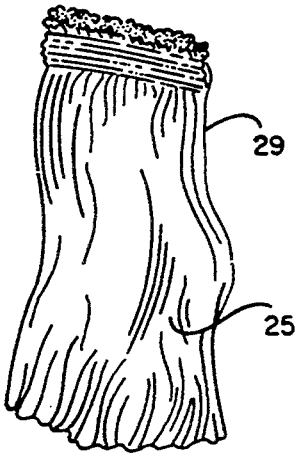
FIG. 1*c* is a view similar to FIG. 1*b* showing the right half of the mop fabric.
Figure 2:
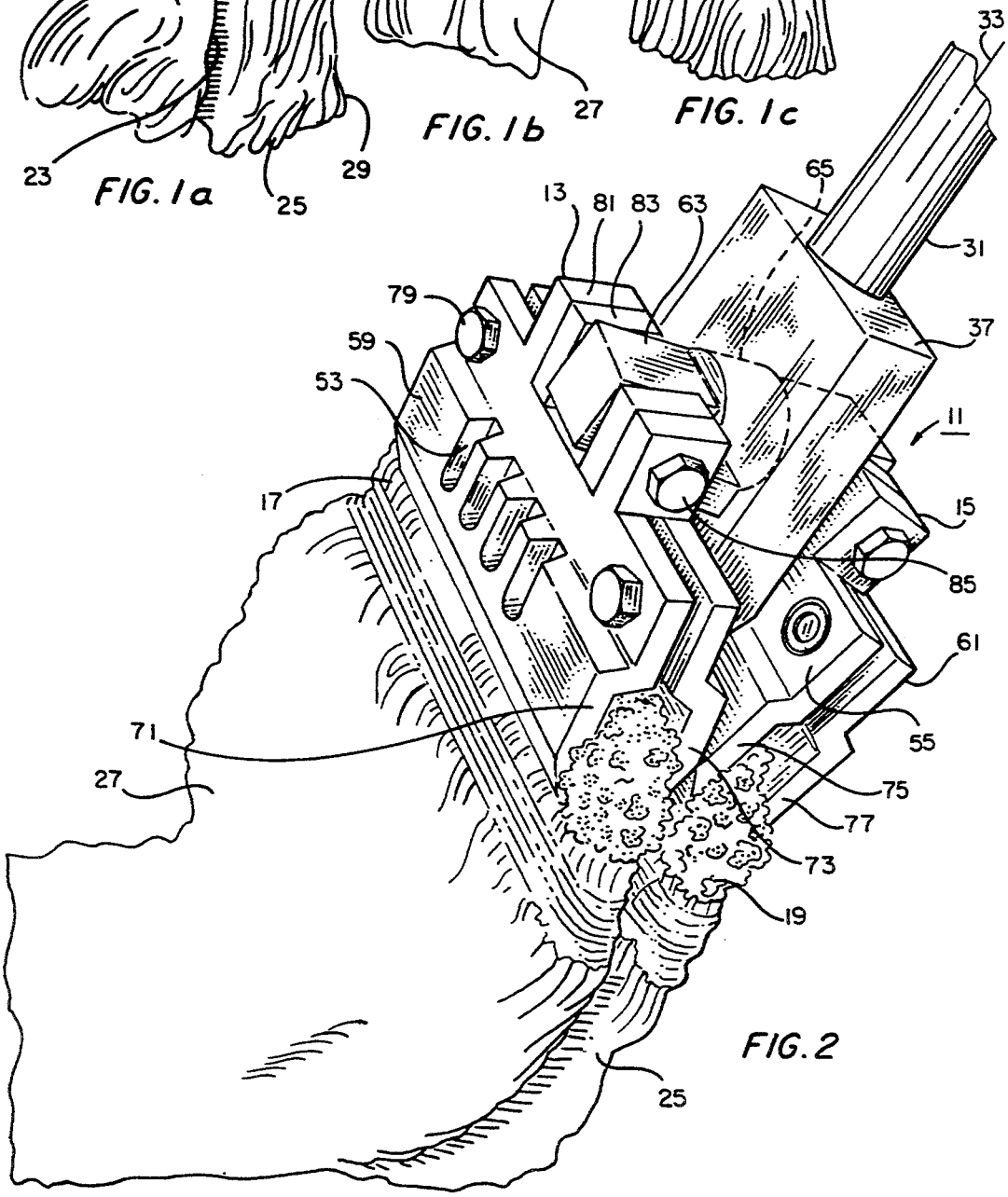
FIG. 2 is a perspective view of the improved mop assembly of the invention in use, the mop handle being partially broken away for ease of illustration.
Figure 3A:
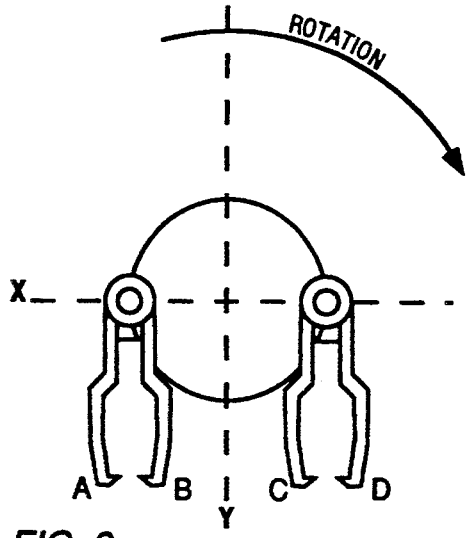
FIGS. 3*a*–3*e* are schematic illustrations which depict the dual rotation features of the improved mop assembly of the invention.
Figure 3B:
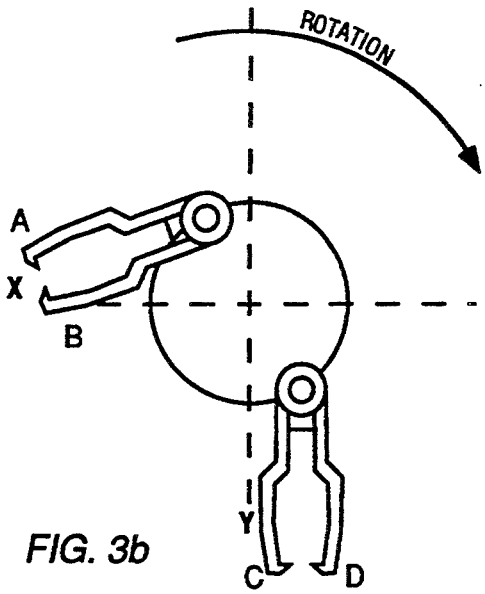
Figure 3C:
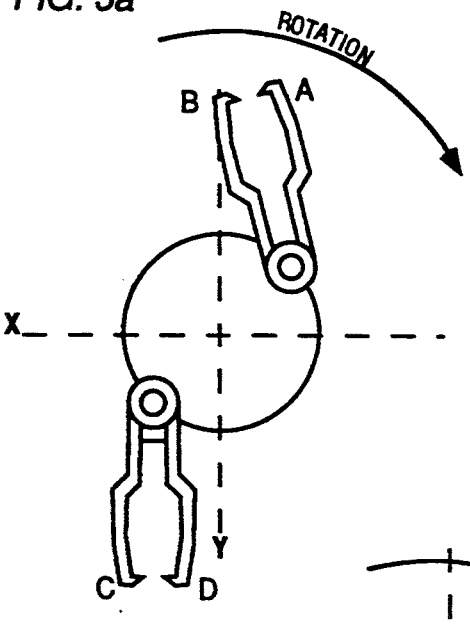
Figure 3D:
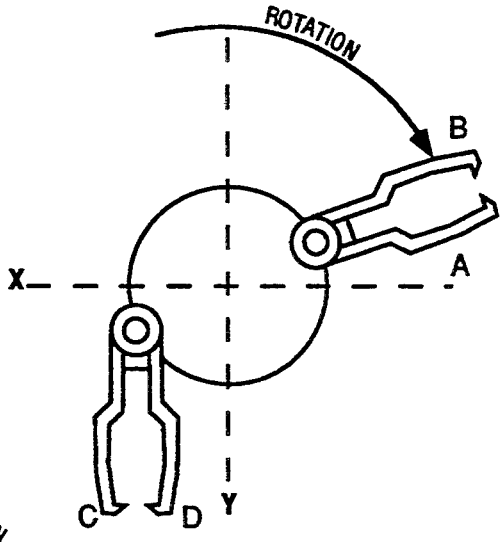
Figure 3E:
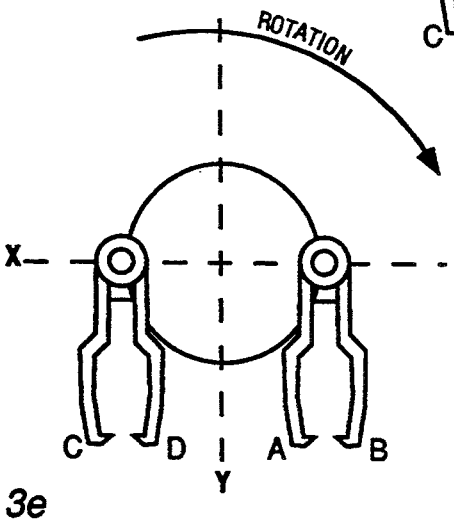

FIG. 2 shows an improved mop assembly of the invention, designated generally as 11. The mop assembly 11 includes a pair of mop holders 13,15, each of which is adapted to hold an associated mop fabric 17,19. The pieces of mop fabric can be made by modifying a traditional piece of mop material (21 in FIG. 1*a*), providing two pieces of mop material, as shown in FIGS. 1*b* and 1*c*. Each separate piece of mop fabric has an inner contact surface 23,25 and an outer contact surface 27,29. The mop fabric is preferably comprised of loops of yarn sewn together at one or both ends but could also be comprised of loose rags, sponge material and other natural or synthetic fabrics which can absorb water or liquids.

Figure 6:
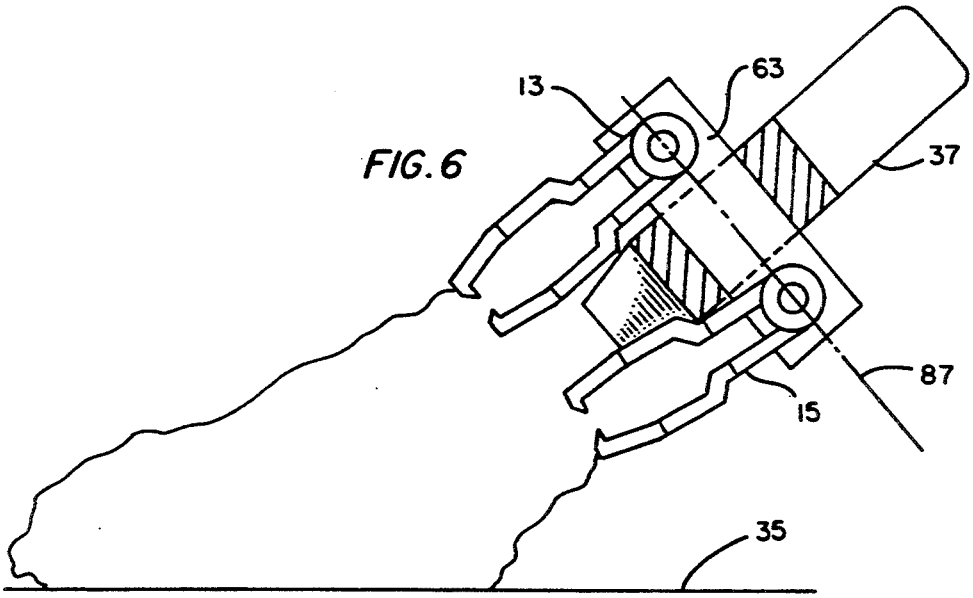
FIG. 6 is a side view of the mop assembly of FIGS. 4–5 in use and showing the position of the inner and outer contact surfaces of the mop fabric.

The mop assembly 11 also has an elongate handle 31 having a longitudinal axis 33. The handle 31 is connected to the pair of mop holders 13,15 for positioning the mop holders in relation to a work surface, such as the floor surface (35 in FIG. 6).

The mop assembly of the invention also has a rotating means for pivoting the mop holders about the longitudinal axis 33 of the mop handle 31 during use, whereby the inner and outer contact surfaces 23,25 and 27,29, respectively, of the mop fabric are reversed.

Figure 7:
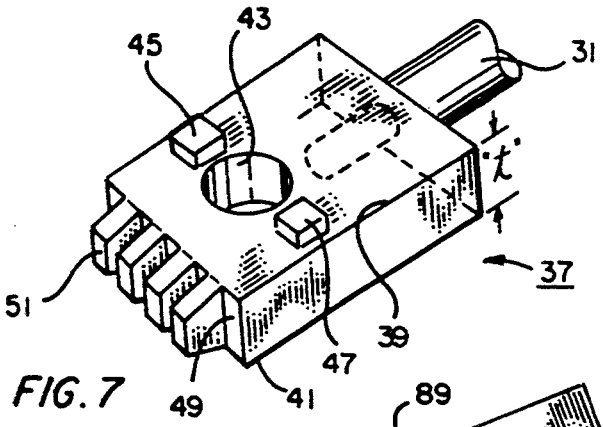
FIG. 7 is an isolated view of the support plate which forms a portion of the improved mop assembly.

As shown in FIG. 7, the rotating means includes a generally planar support plate 37 connected to the handle 31. The support plate 37 is generally rectangular having opposing planar faces 39,41 separated by a thickness "t". A transverse opening 43 is located just below the mid line of the planar face 39 and communicates with the opposing face 41. Each planar opposing face 39,41 is provided with a pair of spaced apart stops (45,47 shown) which encourage the top or upper holder (13 in FIG. 6) to work in unison with the bottom holder (i.e., the holder in contact with the floor) by not swinging away or out during mopping of a work surface. The support plate 37 also has an end face 49 opposite the junction with the handle 31 which is provided with means for engaging selected portions of the mop holder inner and outer surfaces. The means can comprise, for example, four locking lugs 51. The locking lugs 51 are spaced apart a preselected distance to engage mating lug notches 53 (see FIG. 2) formed in each of the mop holder inner and outer faces 55,57 and 59,61, respectively. It will be understood that other mating locking means could be utilized as well such as mating serrated surfaces provided on the support plate and the mop head inner and outer surfaces.

A rotor shaft 63 (FIG. 2) has a central portion 65 which is received within the transverse opening 43 of the support plate 37. The rotor shaft 63 also has oppositely arranged outer extents, each of which is pivotally connected to a selected one of the pair of mop holders 13,15, whereby rotation of the mop handle 31 about the longitudinal axis 33 rotates the support plate 37 and the rotor shaft 63, causing the mop holders 13,15 to pivot about the longitudinal axis 33 of the handle 31, whereby the inner and outer contact surfaces 33,35 and 37,39 of the mop fabric are reversed.

Figure 5:
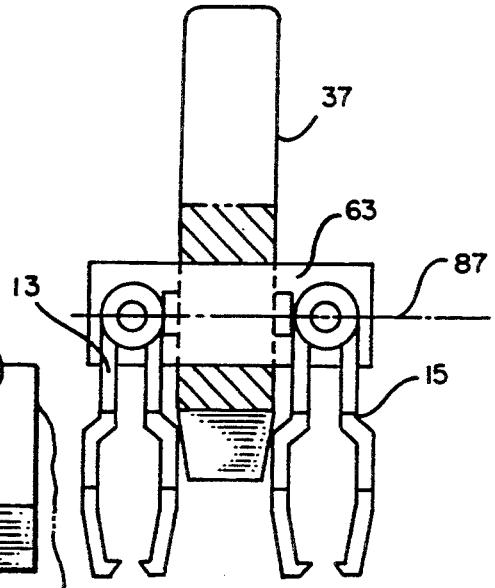
FIG. 5 is an end view of the mop assembly of FIG. 4 showing the initial position of each mop holder.

As shown in FIGS. 2 and 5, the central portion 65 of the rotor shaft 63 is a generally cylindrical member which is closely received within the cylindrical opening provided in the support plate 37 with the rotor shaft oppositely arranged outer extents 67,69 extending generally perpendicular to the opposing planar faces of the support plate.

The mop holders 13,15, as shown in FIG. 2, comprise mating sets of clamshell grippers 71,73 and 75,77. Each pair of grippers has an end opening and cooperating gripping surfaces in the interior thereof for gripping a portion of mop fabric. The size of the end openings of the grippers is adjustable, for example, by bolts 79 or other means to accommodate mop fabric of various types and thickness and to allow removal and replacement of the mop fabric. In the embodiment of the invention shown in FIG. 2, each mop holder 13,15 also includes upwardly extending flanges, e.g. 81,83, having mating transverse openings to receive a cross bolt 85, for pivotal attachment of the mop holders to the rotor shaft 63.

Figure 10:
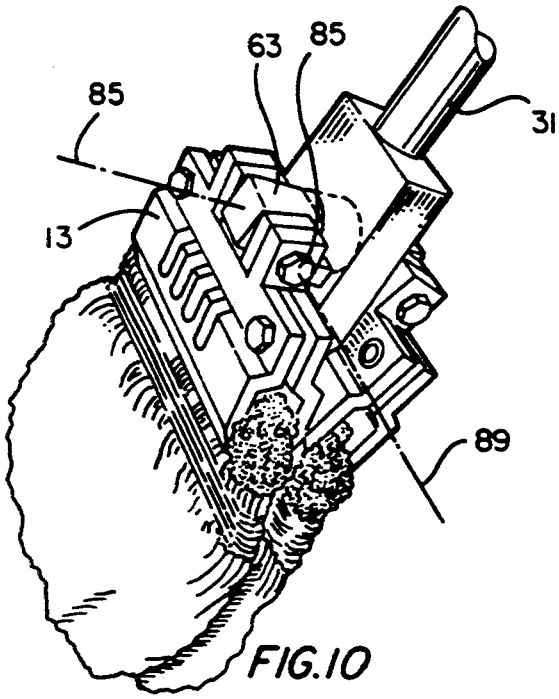
FIGS. 10–13 illustrate the dual rotation features of the mop assembly from the normal use position of FIG. 10 through one complete rotation, as illustrated in FIGS. 11–13.

As shown in FIG. 10, each mop holder 13 is both rotatable about the axis 87 extending from the rotor shaft and pivotable about the axis 89 which extends from the cross bolt 85.

FIGS. 3*a*–3*e* illustrate the rotation of the mop holders during a typical cycle in schematic fashion. It will be noted that the fabric grippers A,B,C,D in FIG. 3*a* finish the cycle in reverse positions in FIG. 3*e*. The resulting action causes the inner contact surfaces (generally at B,C in FIG. 3*a*) of the mop material to become the outer contact surfaces in FIG. 3*e* while the outer contact surfaces (A,D in FIG. 3*a*) become the inner contact surfaces.

Figure 4:
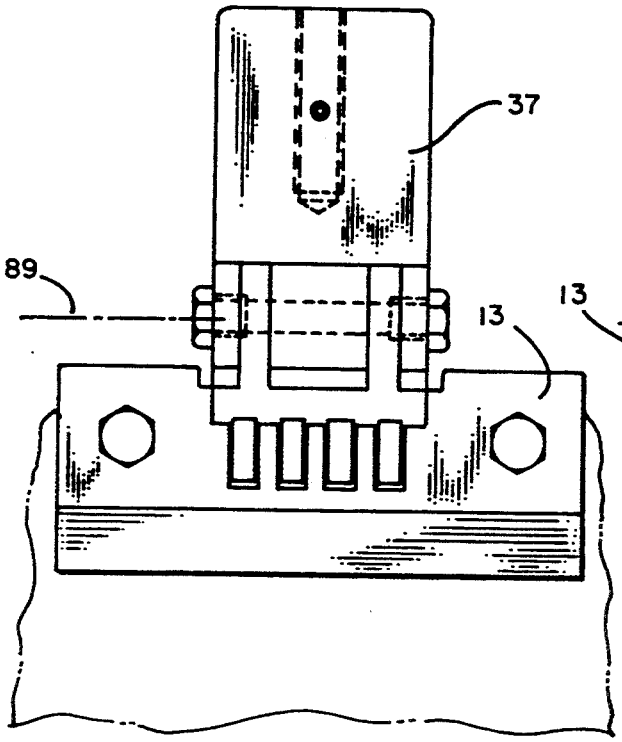
FIG. 4 is an isolated, side view of one mop holder, the mop fabric and mop handle being broken away.

As shown in FIGS. 4 and 5, the mop holders hang down in general alignment with the handle longitudinal axis if the mop is lifted vertically. In use, the stops 45, 47 of the support plate 37 also engage mating surfaces in the mop holders (e.g., flanges 81, 83 in FIG. 2) to limit rotation of the mop holder about the axis 89. The bulk of the fabric material generally holds the mop holder 13 (FIG. 6) in the position shown during use.

Figure 8:
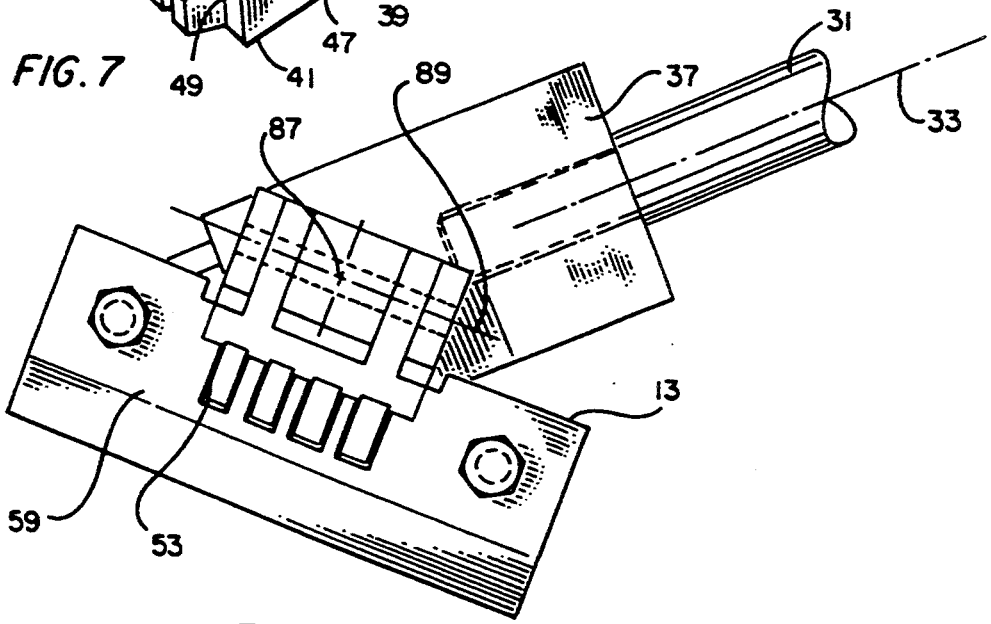
FIG. 8 is a side, isolated view of the mop holders and support plate in the starting position for reversing the contact surfaces of the mop fabric, the handle being partly broken away for ease of illustration.
Figure 9:
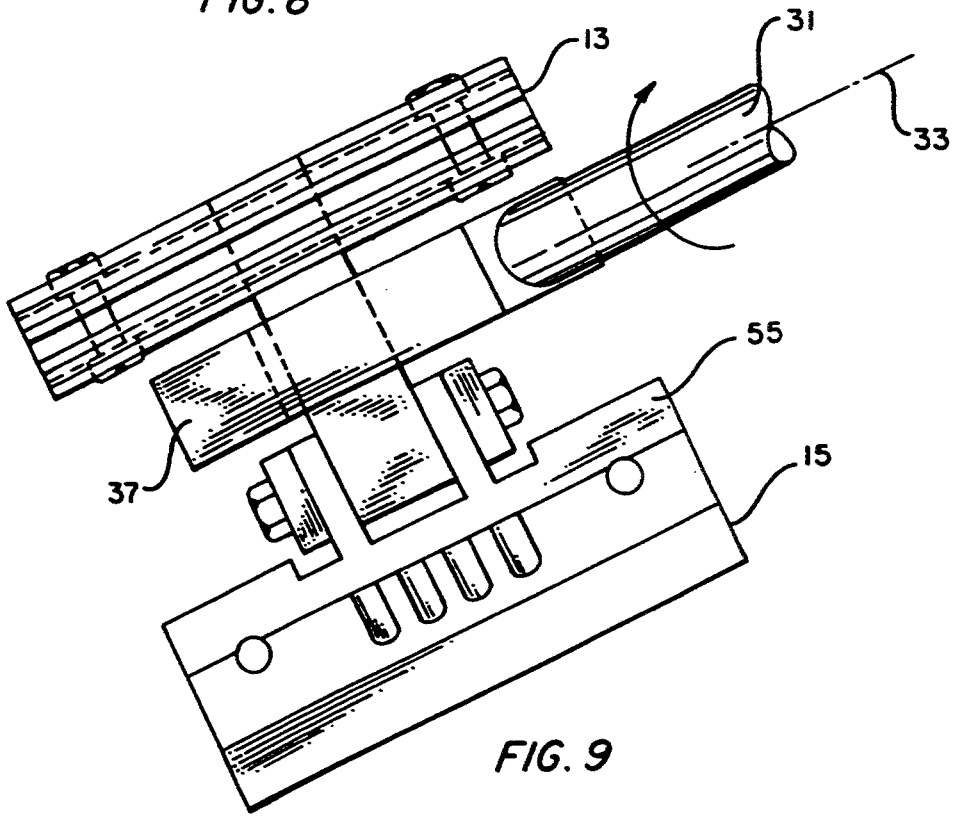
FIG. 9 is a view similar for FIG. 8 but showing the rotation at mid-point of the mop holders about the longitudinal axis of the mop handle.

To reverse the position of the contact surfaces of the mop fabric, the handle 31 is first moved to the approximate position shown in FIG. 8 so that the handle makes an angle of between about 45 and 0 degrees with the axis 89. As shown in FIG. 9, the user then rotates the mop handle about the axis 33, causing the mop holder 13 to pivot approximately 90 degrees about the axis 33 to the position shown in FIG. 9. An additional 90 degree rotation of the handle brings the mop holders back to the position shown in FIG. 8, but with the holders in the reverse positions from the starting position. The movement of the mop holders is also shown in sequential, perspective fashion in FIGS. 11–13.

Figure 11:
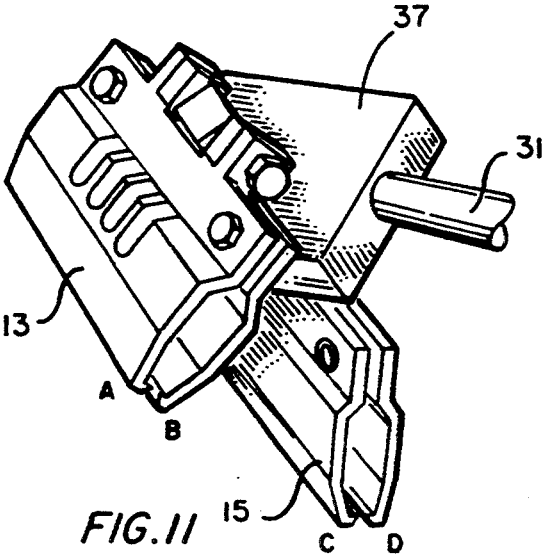
Figure 12:
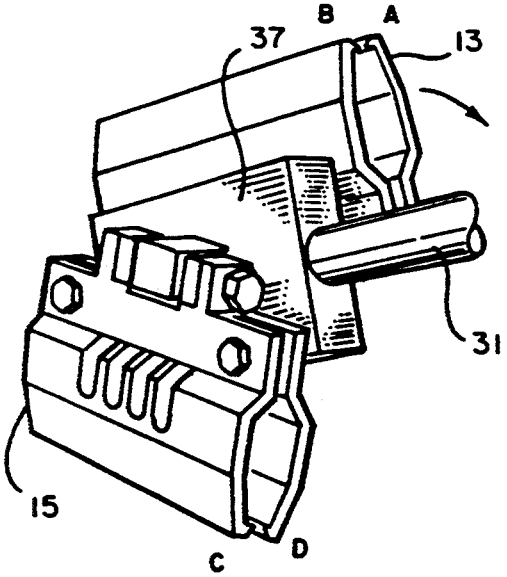
Figure 13:
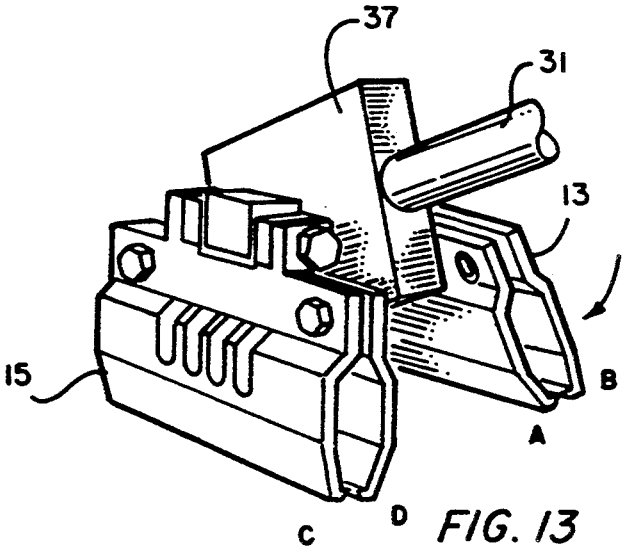

In normal use, a user dips the mop fabric into a container of liquid and then mops a work surface with the mop holders in the starting position shown in FIG. 2. The user grips the mop handle and moves the mop fabric outer contact surfaces over the work surface applying the liquid to at least a portion of the work surface. The handle is then moved to the starting position of FIG. 8 and then rotated to pivot the mop holders about the longitudinal axis of the handle, whereby the inner and outer contact surfaces of the mop fabric are reversed, as shown in FIGS. 11–13. The mop can then be used to continue mopping the work surface prior to again dipping the mop fabric into the container of liquid.

An invention has been provided with several advantages. The improved mop assembly is simple in design and economical to manufacture. It is adapted to use existing mop fabric designs with only minor modifications including cutting the mop material in half. The dual rotation feature allows a greater work area to be covered with clean mop surface without the necessity of frequently dipping the mop material in a container of liquid. The mop holders can be fabricated from light weight synthetic materials, such as plastics, and add little bulk or weight to the traditional mop design.

While the invention has been shown in only one of its forms, it is not thus limited but is susceptible to various changes and modifications without departing from the spirit thereof.

What is claimed is:

1. An improved mop assembly, comprising:

a pair of mop holders, each holder gripping an associated mop fabric having an inner contact surface and an outer contact surface;

a handle having a longitudinal axis, the handle being connected to the pair of mop holders for positioning the mop holders in relation to a work surface;

rotating means for pivoting the mop holders about the longitudinal axis of the handle during use, whereby the inner and outer contact surfaces of the mop fabric are reversed.

2. An improved mop assembly, comprising:

a pair of mop holders, each holder gripping an associated mop fabric having an inner contact surface and an outer contact surface;

a handle for positioning the mop holders in relation to a work surface;

a support plate connected to the handle, the support plate having a transverse opening therein;

a rotor shaft having a central portion which is received within the transverse opening of the support plate and having oppositely arranged outer extents, each outer extent being pivotally connected to a selected one of the pair of mop holders, whereby rotation of the mop handle about the longitudinal axis rotates the support plate and the rotor shaft, causing the mop holders to pivot about the longitudinal axis of the handle, whereby the inner and outer contact surfaces of the mop fabric are reversed.

3. The improved mop assembly of claim 2, wherein each mop fabric is a yarn fabric.

4. The improved mop assembly of claim 2, wherein each mop holder has an inner face and an outer face, each of the inner and outer faces having a plurality of locking surfaces formed therein and wherein the support plate has an end face with mating locking surfaces formed thereon, and wherein the mating locking surfaces of the support plate end face cooperate with selected ones of the locking surfaces of the mop holders during use, thereby limiting rotational movement of the rotor shaft within the support plate during normal use of the mop assembly.

5. The improved mop assembly of claim 4, wherein the support plate also has opposing planar faces, each opposing planar face being provided with a pair of spaced apart stops which cause the mop holders to operate in tandem by maintaining the relative alignment of the mop holders during use.

6. The improved mop assembly of claim 5, wherein the central portion of the rotor shaft is a generally cylindrical member which is closely received within a cylindrical opening provided in the support plate with the rotor shaft oppositely arranged outer extents extending generally perpendicular to the opposing planar faces of the support plate.

7. The improved mop assembly of claim 6, wherein the mop holders comprise mating sets of clamshell grippers having end openings and cooperating gripping surfaces for gripping a portion of mop fabric, and wherein the end opening of each set of mating clamshell grippers is adjustable in size to accommodate mop fabric of various types and thicknesses.

8. A method of mopping a work surface, the method comprising the steps of:

providing a mop assembly having a pair of mop holders, each holder gripping an associated mop fabric with an inner contact surface and an outer contact surface;

providing a handle for the mop assembly having a longitudinal axis, the handle being connected to the pair of mop holders for positioning the mop holders in relation to a work surface;

providing rotating means for pivoting the mop holders about the longitudinal axis of the handle during use;

gripping the handle and moving the mop fabric outer contact surfaces over the work surface;

rotating the handle to pivot the mop holders about the longitudinal axis of the handle, whereby the inner and outer contact surfaces of the mop fabric are reversed; and continuing use of the mop assembly by moving the mop fabric over the work surface.

9. A method of applying a liquid from a container to a work surface with a mop, the method comprising the steps of:

providing a mop assembly having a pair of mop holders, each holder gripping an associated mop fabric with an inner contact surface and an outer contact surface;

providing a handle for the mop assembly having a longitudinal axis, the handle being connected to the pair of mop holders for positioning the mop holders in relation to a work surface;

providing rotating means for pivoting the mop holders about the longitudinal axis of the handle during use;

dipping the mop fabric into the container of liquid;

gripping the handle and moving the mop fabric outer contact surfaces over the work surface to applying the liquid to at least a portion of the work surface;

rotating the handle to pivot the mop holders about the longitudinal axis of the handle, whereby the inner and outer contact surfaces of the mop fabric are reversed; and continuing use of the mop assembly by moving the mop fabric over the work surface prior to again dipping the mop fabric into the container of liquid.

10. The method of claim 9, wherein mop assembly is used to remove a liquid from a work surface by moving the mop assembly over the work surface as previously described and then wringing the mop fabric over a container for the liquid.

* * * * *